US010433041B2

(12) United States Patent
Garrett et al.

(10) Patent No.: US 10,433,041 B2
(45) Date of Patent: Oct. 1, 2019

(54) OUTDOOR LOUDSPEAKER WITH INTEGRAL LIGHTING

(71) Applicant: Harman International Industries, Inc., Stamford, CT (US)

(72) Inventors: James Garrett, Simi Valley, CA (US); Fred Tubis, Northridge, CA (US); An Duc Nguyen, West Hills, CA (US); Aaron L. Butters, Thousand Oaks, CA (US); Timothy Gladwin, Pakenham (CA)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/495,418

(22) Filed: Apr. 24, 2017

(65) Prior Publication Data

US 2017/0311062 A1 Oct. 26, 2017

Related U.S. Application Data

(60) Provisional application No. 62/326,107, filed on Apr. 22, 2016.

(51) Int. Cl.
*H04R 1/02* (2006.01)
*H04R 9/06* (2006.01)
(Continued)

(52) U.S. Cl.
CPC ..... *H04R 1/028* (2013.01); *F21V 3/00* (2013.01); *F21V 23/001* (2013.01); *F21V 33/0056* (2013.01); *H04R 1/023* (2013.01); *H04R 1/025* (2013.01); *H04R 3/12* (2013.01); *H05B 33/0803* (2013.01); *H05B 33/0854* (2013.01);
(Continued)

(58) Field of Classification Search
CPC .. F21V 33/00; F21V 33/0052; F21V 33/0056; H04R 1/028
USPC ..... 381/61, 80, 81, 82, 124, 87, 334, 386, 381/395; 362/86
See application file for complete search history.

(56) References Cited

U.S. PATENT DOCUMENTS 3,194,952 A * 7/1965 Wells ..... F21S 8/088 181/141
3,679,845 A * 7/1972 Geloso ..... H04R 1/028 362/86

(Continued)

OTHER PUBLICATIONS

Terra Speakers, http://terraspeakers.com/our-products/ls-series/, "LS Series Waterproof, Outdoor Speakers", Feb. 2016, 2 pages.

(Continued)

*Primary Examiner* — Xu Mei
(74) *Attorney, Agent, or Firm* — Brooks Kushman, P.C.

(57) ABSTRACT

An outdoor loudspeaker that is weather resistant and includes environmental lighting is described. The lamp is mounted to a cap at the top of the loudspeaker. An audio driver is mounted below the lamp. A system outdoor loudspeakers is also described. The lighting circuitry and the audio circuitry is separate, e.g., separate conduits and wiring in the loudspeaker. The cap can include a light guide, e.g., a lens centrally mounted in the cap or an opaque cover to direct the light downwardly and outwardly. At least part of the loudspeaker can be mounted underground and, in the case of a sub-woofer, the entire chamber can be mounted below ground.

17 Claims, 11 Drawing Sheets

(51) Int. Cl.

| | |
|---|---|
| ***H04R 3/12*** | (2006.01) |
| ***H05B 33/08*** | (2006.01) |
| ***F21V 3/00*** | (2015.01) |
| ***H05B 37/02*** | (2006.01) |
| ***F21V 23/00*** | (2015.01) |
| ***F21V 33/00*** | (2006.01) |
| *F21Y 115/10* | (2016.01) |
| *F21Y 113/13* | (2016.01) |
| *F21W 131/10* | (2006.01) |

(52) U.S. Cl.

CPC ..... *H05B 33/0872* (2013.01); *H05B 37/0236* (2013.01); *F21W 2131/10* (2013.01); *F21Y 2113/13* (2016.08); *F21Y 2115/10* (2016.08); *H04R 2201/025* (2013.01); *H04R 2420/07* (2013.01)

(56) References Cited

U.S. PATENT DOCUMENTS

| | | | | |
|---|---|---|---|---|
| 5,802,193 | A * | 9/1998 | Kieltyka | H04R 1/345 381/189 |
| 6,021,208 | A * | 2/2000 | Kin-Lung | A63H 3/28 181/199 |
| 6,580,361 | B2 | 6/2003 | Bucher | |
| 7,066,613 | B2 * | 6/2006 | Vishwamitra | A63J 17/00 362/343 |
| 7,234,841 | B2 * | 6/2007 | Nash | F21V 17/02 362/269 |
| 8,411,878 | B2 * | 4/2013 | Adam | H01R 4/2408 381/120 |
| 8,666,104 | B2 * | 3/2014 | Ivey | H04R 1/028 181/141 |
| 8,873,788 | B1 * | 10/2014 | Coombs | H04R 1/2811 181/150 |
| 9,004,706 | B1 * | 4/2015 | Banfield | F21V 33/0056 362/86 |
| 2006/0126860 | A1 * | 6/2006 | Sievers | F21V 21/0824 381/77 |
| 2007/0109763 | A1 * | 5/2007 | Wolf | A01M 1/2083 362/86 |
| 2008/0080168 | A1 | 4/2008 | Harris et al. | |
| 2008/0240468 | A1 | 10/2008 | Adam | |
| 2016/0097509 | A1 * | 4/2016 | Honda | F21L 4/00 362/249.02 |

OTHER PUBLICATIONS

Sonance-Landscape Series: http://www.sonance.com/outdoor/sonance-landscape-series, 6 pages.

James All-Terrain Series: http://www.jamesloudspeaker.com/categories/55, 2 pages.

* cited by examiner

OUTDOOR LOUDSPEAKER WITH INTEGRAL LIGHTING

CROSS-REFERENCE TO RELATED APPLICATIONS

This application claims the benefit of U.S. provisional application Ser. No. 62/326,107 filed Apr. 22, 2016, the disclosure of which is hereby incorporated in its entirety by reference herein.

TECHNICAL FIELD

The present disclosure generally relates to speakers, and more particularly, to outdoor loudspeakers.

BACKGROUND

Loudspeakers are used in audio systems for the reproduction of sound. In some applications, the speakers may be used outdoors. As the loudspeakers are used outdoors, elements can be a problem. Moisture, e.g., rain, can ruin a loudspeaker. In some cases, direct sunlight, e.g., in the southwest United States, can ruin some components in a loudspeaker.

SUMMARY

In at least one embodiment, a loudspeaker is weather resistant and includes environmental lighting.

An outdoor loudspeaker system can include a plurality of outdoor loudspeakers with at least some of the loudspeakers including a lamp and at least one audio driver. A lighting controller is in communication with a lamp or multiple lamps and may output lighting signals to the lamps in the plurality of outdoor loudspeakers. An audio controller is in communication with the audio driver(s) and can output audio signals to the audio drivers of the plurality of outdoor loudspeakers. In an example, a lighting conduit houses lighting wiring from the lighting controller to the plurality of outdoor loudspeakers. In an example, an audio conduit houses audio wiring from the audio controller to the plurality of outdoor loudspeakers, the audio conduit being separate from the lighting conduit.

In an example embodiment, the outdoor loudspeaker of the plurality of outdoor loudspeakers includes a base to contact ground, a top on the base and a cap on the top, and wherein the lamp is mounted beneath the cap and outside the top.

In an example embodiment, the lighting wiring extends into the base and through the top to the lamp.

In an example embodiment, the audio conduit and the lighting conduit extend below ground to the base.

In an example embodiment, the cap is opaque above the lamp to direct the light below the cap and the cap covers the top to protect the top and the audio driver from the environment.

In an example embodiment, the cap includes a brim outside the top and the lamp is mounted in the brim.

In an example embodiment, the cap includes a centrally mounted lamp and a lens above the lamp, the lens is mounted in webs in the cap above the audio driver. The audio driver is configured to direct audio signals upwardly around the lens and through interstices between the webs.

In an example embodiment, the cap includes lamps mounted around the periphery facing downwardly with light being emitted through a gap between the top and the cap.

In an example embodiment, a spike extends downwardly to secure the loudspeaker to the ground.

In an example embodiment, the audio driver is a woofer mounted in a chamber and the chamber being adapted beneath the ground.

In an example embodiment, a sound pipe is configured to transmit the sound waves from the chamber to an outlet at the cap. The cap can include the lamp mounted around the periphery.

In an example, the light controller sends a first control signal to the lamps to control the quantity of light from the lamps and may send a second control signal to select the color of light from the lamps.

An example embodiment of an outdoor loudspeaker includes an elongate base configured to be at least partially mounted in the ground, a top on the base, a plurality of audio drivers mounted in the top, a cap on the top and a lamp mounted in the cap, the cap being adapted to cover the lamp and direct emitted light downwardly and outwardly from the cap. In an example embodiment, first circuitry is connected to the audio drivers. In an example embodiment, second circuitry is separate from the first circuitry and connected to the lamp.

In an example embodiment, the cap includes a brim extending outwardly of the top, and wherein the lamp is mounted in the brim.

In an example embodiment, the cap includes a centrally mounted lamp and a lens above the lamp. The lens can be mounted in webs in the cap above the audio drivers. In an example embodiment, at least one of the plurality of audio drivers is configured to direct audio signals upwardly around the lens and through interstices between the webs.

In an example embodiment, the cap includes lamps mounted around the periphery facing downwardly with light being emitted through a gap between the top and the cap.

In an example embodiment, a spike extends downwardly from the body of the loudspeaker to secure the loudspeaker to the ground.

In an example embodiment, the lamp includes light emitting diodes that can emit ranges of wavelengths to control the color of light emitted from the lamp.

In an example embodiment, the audio driver is below the lamp.

In an example, embodiment, the lamp includes circuitry to receive signals to control at least one of or both the quantity of light and the color of light emitted therefrom.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
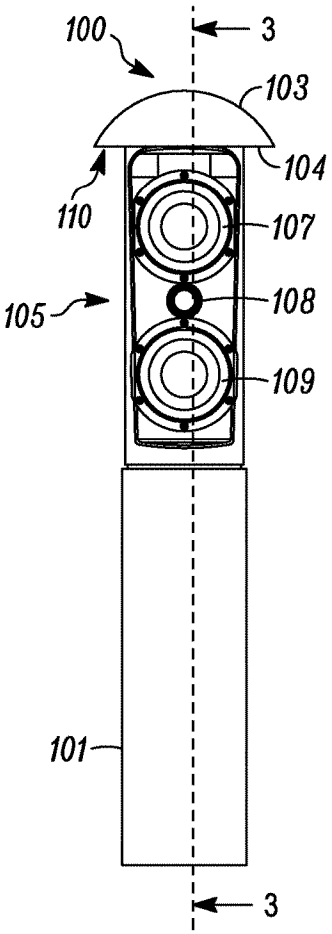
FIG. 1 illustrates an elevational, front view of a loudspeaker according to an embodiment of the present disclosure.

FIG. 1 is a schematic view of one example of an outdoor loudspeaker 100 with a base 101 and a top 102 connected to the top of the base 101. The top 102 can be elongate to position speakers therein to be spaced above the base 101. The base 101 can be elongate to elevate the speaker top 102, and the speaker assembly 105 therein, above the ground or elevated above a support structure. The base 101 may include a hollow interior to allow wiring or other electrical connections to extend through the base 101 to the speaker assembly 105 in the top 102. The base 101 and the top 102 may be cylindrical in shape or ovoid in cross section. In another example, the walls of the base or the top form a prism or right prism. The walls that form either the base 101 or top 102 are relatively thin and form a hollow interior to receive electrical connections for both lighting and sound signals. The base 101 is configured to be partially installed beneath the ground. In an example embodiment, the base 101 has between half and three-quarters of its height installed beneath the ground when installed.

A cap 103 is fixed to the top portion 102 remote from the base 101. The cap 103 can be a dome with a rounded top and a dimension, e.g., a diameter, greater than a dimension of the top portion 102 and greater than a dimension of the base 101. The cap 103 can be positioned on the top of the top portion 102. The cap 103 can be dimensioned and shaped to shield, at least partially, the top 102 and base 101 from the environment, e.g., rain and sun. The cap 103 can have a dome shape with a continuous body. The cap 103 includes a brim 104 that extends outwardly past the walls of the top 102. A raceway can be positioned in the brim whereat a lamp can be fixed. The raceway is positioned outside the top 102. The raceway can extend around the entirety of the brim. In an example, embodiment the raceway extends about halfway around the brim. The raceway may extend only around the front of the outdoor loudspeaker and the sides, i.e., the rear of the loudspeaker does not have a raceway or a lamp. The raceway can act as a light guide to transmit light throughout the brim and outwardly from the raceway.

The lamp 110 is positioned in the cap brim so that light is emitted into the surrounding environment outside the outer walls of the top 102. The lamp 110 may include at least one or a plurality of light sources. The light sources may be covered by a lens that diffuses the light and protects the light source from the environmental elements. In an example, the light source includes a plurality of solid state light sources, e.g., light emitting diodes (LEDs). The plurality of solid state light sources is positioned in the brim 104 with the emitting side thereof outside the top portion 102. In an example, the light sources are equally spaced around the brim 104. The cap 103 directs the light from the lamp or the light source downwardly and outwardly. The cap 103, in some embodiments, blocks the light from being emitted upwardly or directly laterally from the cap. In an example, the light sources are positioned to be aligned with the speakers 107-109. In an example, there are at least four light sources, six light sources, at least ten light sources, at least twelve light sources or more. The light sources can be spread spectrum, e.g., white, light sources. In an example, the light sources are color light sources. The color of the light sources can be controlled by circuitry within the loudspeaker 100. That is, the light sources emit a narrower band light wavelengths to tune emission to a specific color. In an example, the change in the color of the lights can be controlled by the frequencies in the music being played by the speaker assembly 105. The light may additionally be controlled to change color of flashing patterns based on preloaded lighting instructions or circuitry. In an example, the lamp 110 is separate from the audio, e.g., the wiring, circuitry and speakers. Thus, the lamp 110 is controlled by different circuitry than the audio. The power supply to the lamp is transmitted on a different circuit than the audio signal circuitry.

The lamp 110 may be part of a series of lamps that are connected to lighting circuitry to power the lamps. The lighting circuitry can power the lamps and provide an on/off signal. The lighting circuitry is separate from the audio circuitry. The lighting circuitry can provide a constant power signal, e.g., a DC voltage. The power signal can be 3 volts, 5 volts, or 12 volts.

In an example, additional lighting devices may be positioned on the top 102. Such additional lighting devices can be below the speaker assembly 105 or on the back of the top 102. The additional lighting may extend around the speakers 107-109. The additional lighting can be controlled by the lighting circuitry, separate from the audio circuitry.

The speaker assembly 105 may include at least one driver, which converts electrical signals into audio signals broadcast from a driver of a speaker assembly 105 to be transmitted through the air. In an example, the speaker assembly 105 includes a first audio driver 107, a second audio driver 108 and a third audio driver 109. At least one of these drivers 107-109 has a different frequency response than at least one of the other drivers. The drivers 107-109 are for outdoor use with some weather resistance. In an example, the drivers 107, 109 are for low and mid-range frequencies of the audio signal. The driver 108 is for high range frequencies of the audio signal. The speaker assembly 105 includes circuitry to receive an input signal appropriately forward a frequency of the input signal to the appropriate driver 107, 108, or 109. The circuitry may also power the driver.

Optionally, the speaker assembly 105 can be covered with a grill, semi-rigid cover or other ornamental structure attached to the top 102. Such a covering may physically protect the speaker assembly 105.

Figure 2:
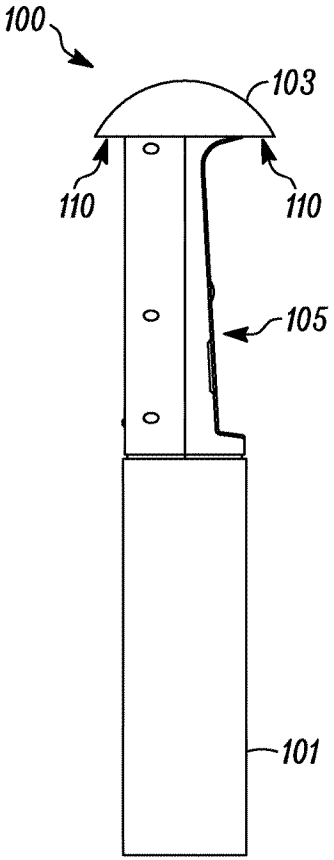
FIG. 2 illustrates a side view of the loudspeaker of FIG. 1.

FIG. 2 illustrates a side view of the outdoor loudspeaker 100. The top 102 includes an inset from the front face such that the speaker assembly 105 is recessed inwardly from the frontmost surface of the top and the base 101. The lamp 110 extends outwardly from the back of the top 102 and the front of the top 102. The cap 103 may extend forwardly of the top 102 to a greater extend toward the front than toward the rear or the sides. In an example embodiment, the brim may be broader toward the front and, hence, may house more lamps.

Figure 3:
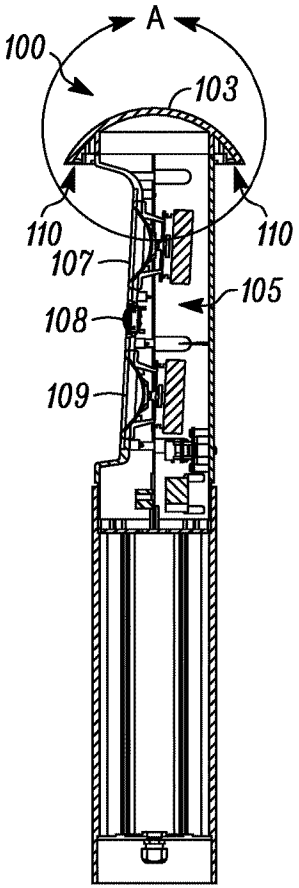
FIG. 3 illustrates a cross sectional view of a loudspeaker, taken generally along line 3-3 in FIG. 1.

FIG. 3 illustrates a cross sectional view of the outdoor loudspeaker 100 taken generally along line 3-3 of FIG. 1. In an example, a lamp is positioned at the bottom of the inset of housing at the top 102. The base 101 may be hollow such that wires for the lighting system and wires for the audio system may extend from underground conduits into the outdoor loudspeaker 100. The lighting conduit can be separate from the audio conduit.

Figure 4A:
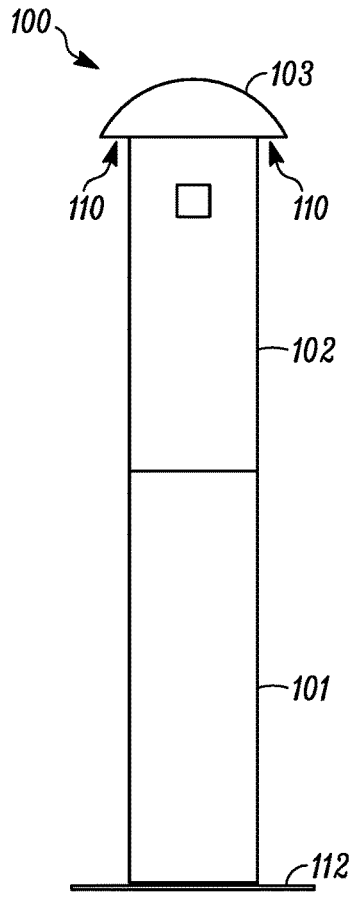
FIG. 4A illustrates a rear view of the speaker system according to an embodiment of the present disclosure.
Figure 4B:
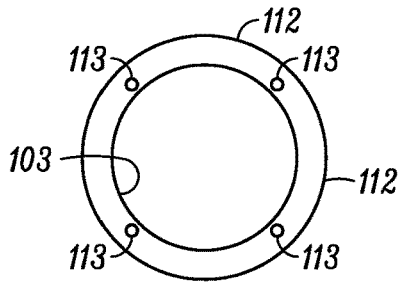
FIG. 4B illustrates a top view of the speaker system in the FIG. 4A embodiment.

FIG. 4A illustrates a rear view of the outdoor loudspeaker 100 with a mount 112. FIG. 4B illustrates a bottom view of the mount 112. The mount 112 extends outwardly from the base 101, e.g., at the bottom of the base 101. The mount 112 may include fasteners or receivers for fasteners 113 to fix the base, and hence, the speaker 100, to an environmental structure, e.g., a deck, stairs, walkway and the like. The mount 112 may be a plate, e.g., a thin metal plate or a polymer plate.

Figure 5:
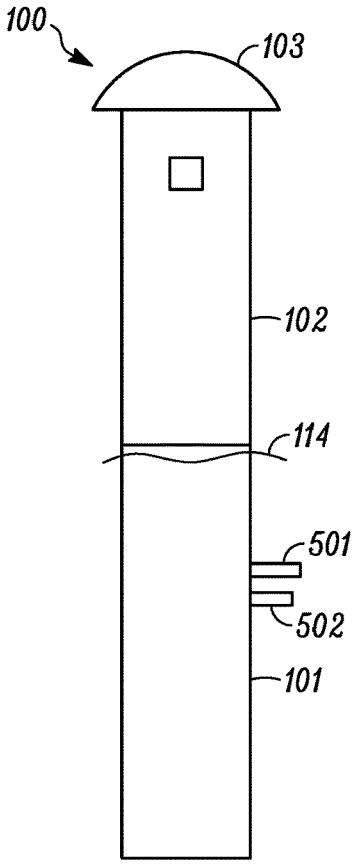
FIG. 5 illustrates a rear view of the loudspeaker mounted in the ground according to an embodiment of the present disclosure.

FIG. 5 illustrates a rear view of the outdoor loudspeaker 100 mounted in the ground 114 according to an embodiment. This embodiment may include or not include the mount 112. The base 101 may have at least a portion thereof being sunk below the ground level. In an example, most of the base 101 is buried below ground. In an example, all of the base 101 is buried below ground. The top 102 may be completely above the ground 114. An audio conduit 501 is connected to the base 101 beneath the ground 114. A lighting conduit 502 is connected to the base 101 beneath the ground 114. The lighting conduit 502 houses power wiring and lighting control wiring. The conduits 501, 502 are separate from each other and spaced to separate the lighting power from the audio signal in the audio wiring to reduce the likelihood of crosstalk or interference from the lighting signals to the audio signals. This may be a concern for non-uniform power signals in the lighting wiring.

Figure 6:
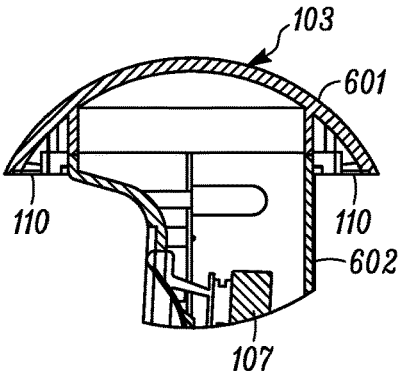
FIG. 6 illustrates an enlarged view of a top of the loudspeaker according to an embodiment of the present disclosure.
Figure 7:
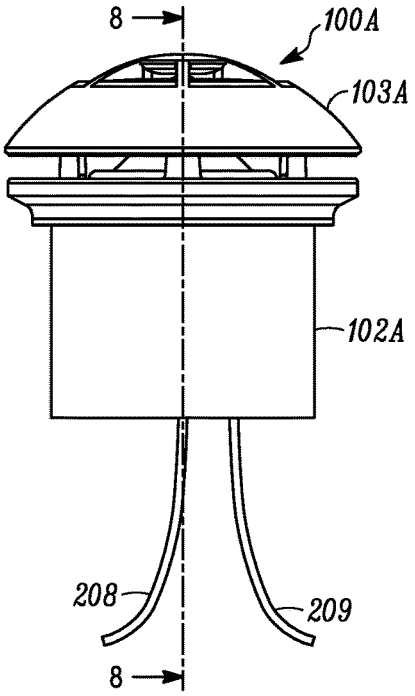
FIG. 7 illustrates an elevational view of a loudspeaker according to an embodiment of the present disclosure.
Figure 8:
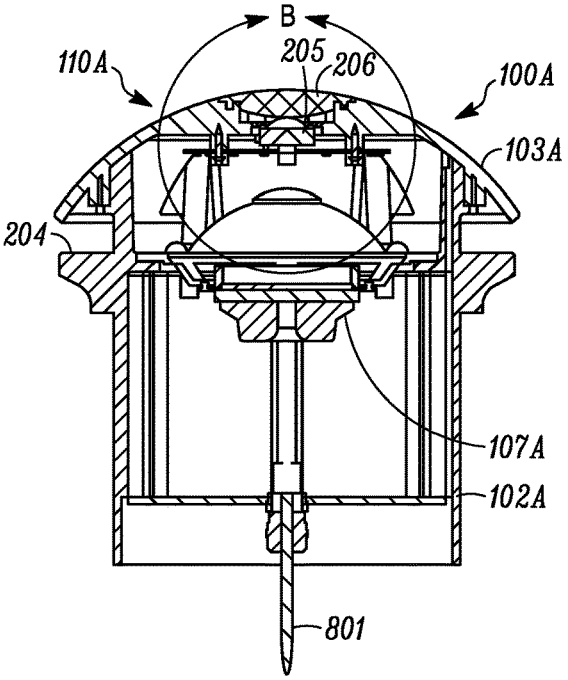
FIG. 8 illustrates a cross sectional view of a loudspeaker, taken generally along line 8-8 in FIG. 7.
Figure 9:
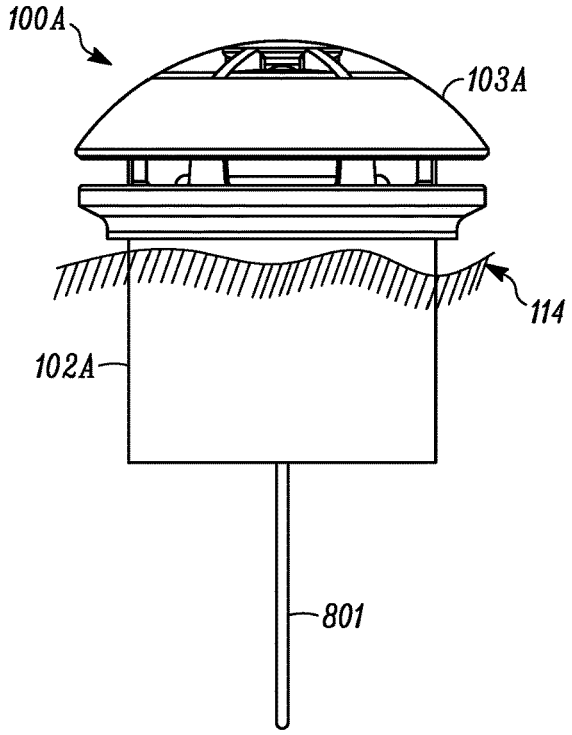
FIG. 9 illustrates a rear view of the loudspeaker mounted in the ground according to an embodiment of the present disclosure.

FIG. 6 illustrates an enlarged, cross-section of part of the top 102, e.g., generally indicated at B in FIG. 3. The lamp 110 is positioned at at least the front and rear of the cap 103, and is covered from above by top shield 601 of the cap 103. The lamp 110 is positioned outwardly of the wall of the top 102 and still beneath the top shield 601. The wall 602 of the top 102 extends to the top shield 601 of the cap 103. The lamp 110 may include at least one light source and a lens covering the light source. In an example, a light pipe may transmit light from the lamps around the periphery of the cap 103. In an example, the light from the lamps 110 is generally directed downwardly toward the base. In an example, the lamps 110 may emit a halo of light around the base 101 with a diameter greater than dimension of top 102 and the base 101. In an example, the lamps 110 may emit light in an arcuate pattern at the front of the speaker 100, e.g., generally centered aligned with the center of the aligned speakers 107, 109.

In an example, the audio signal to the speaker 100 is provided by a different circuit than the signal powering and controlling the lamps 110. The supplies of the audio signal may be in a separate conduit from the wiring of the lighting system.

FIGS. 7-11 show an embodiment of an outdoor speaker 100A. Similar elements to the above embodiment are indicated with the same reference number with the suffix A. A cap 103A is fixed to the top of the housing top 102A. The raceway can support the lamps and extend around the cap 103A above the gap 204A gap 204 is provided between the cap 103A and housing top 102A to provide a sound path from the speaker 107A that is mounted at the top of the housing top 102A and is directed upwardly toward the cap 103A. The cap 103A can direct the sound waves outwardly through the gap 204. In an example, the cap 103A may include apertures to provide additional sound wave paths. That is, the cap 103A is not a continuous domed bode, but has interstices between webs. The lamps 110A includes a light source 205 that is directed upwardly toward a lens or a light pipe 206.

A first wire 208 is connected to the speaker 107A. A second wire 209 is connected to the lamps 110A. The first wire 208 is separate from the second wire 209. A sound controller is connected to the first wire 208. A lighting controller is connected to the second wire 209. The first wire 208, where it extends outside the outdoor speaker 100A, may be housed in a first conduit underground to connect the outdoor speaker 100A to an audio circuitry. The second wire 209, where it extends outside the outdoor speaker 100A, may be housed in a second conduit underground to connect the outdoor speaker 100A to lighting circuitry. The outdoor speaker 100A may include a spike 801 to secure the outdoor speaker 100A in the ground 114. The spike 801 extends from the bottom of the top housing 102A downwardly to reach further into the ground.

Figure 10:
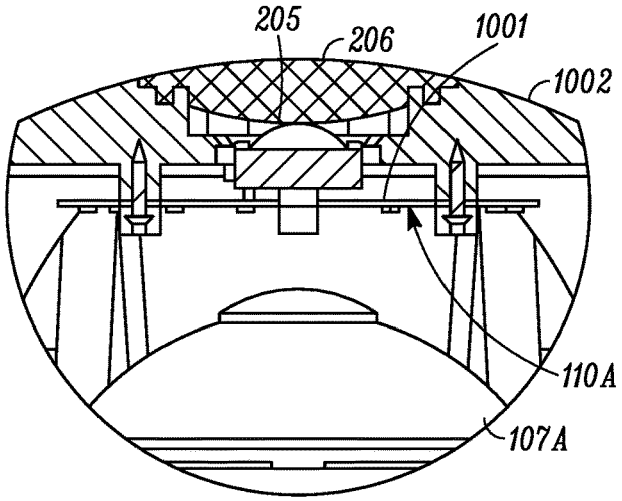
FIG. 10 illustrates an enlarged view of a top of the loudspeaker taken generally along line B in FIG. 8 according to an embodiment of the present disclosure.

FIG. 10 shows and enlarged view of the lamps 110A with the light emitter 205 mounted to a circuit board 1001. The circuit board 1001 can be fixed to underside of the top shield 1002. The lens 206 is mounted into an upwardly facing recess in the top shield 1002.

Figure 11:
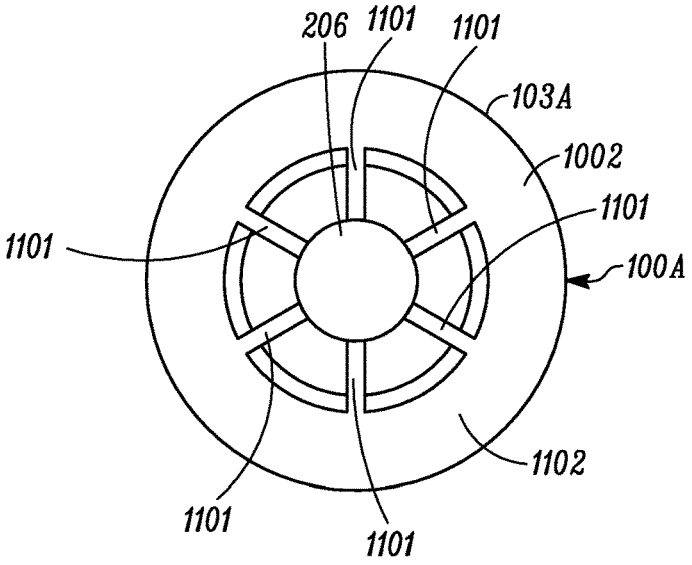
FIG. 11 illustrates a plan view of the loudspeaker according to an embodiment of the present disclosure.

FIG. 11 shows a plan view of the outdoor loudspeaker 100A. The top shield 1002 includes a plurality of webs 1101 that extend inwardly from an outer annular ring 1102. Lamps can be mounted beneath the ring 1102. The lens 206 is supported by the webs. Interstices between the webs 1101 provide sound paths for the audio signals output from the audio driver 107A, which can be coaxially mounted beneath both the lens 205 and the cap 103A.

Figure 12:
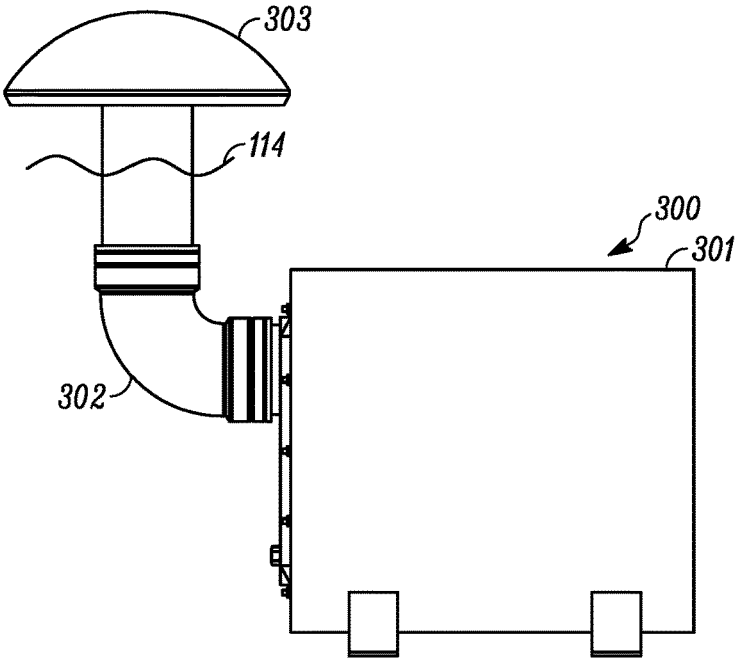
FIG. 12 illustrates an elevational view of a loudspeaker according to an embodiment of the present disclosure, as installed in the ground.
Figure 13:
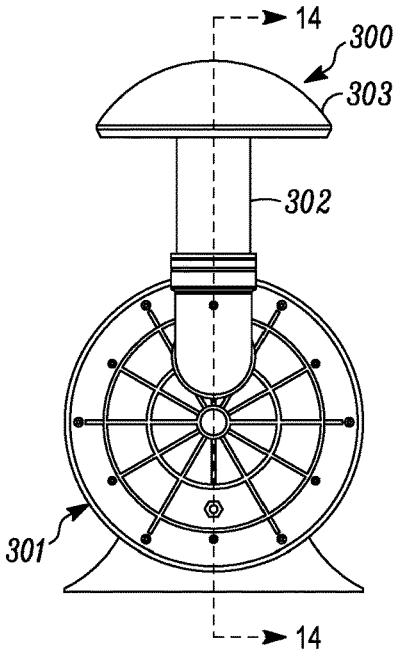
FIG. 13 illustrates a side elevational view of a loudspeaker according to an embodiment of the present disclosure
Figure 14:
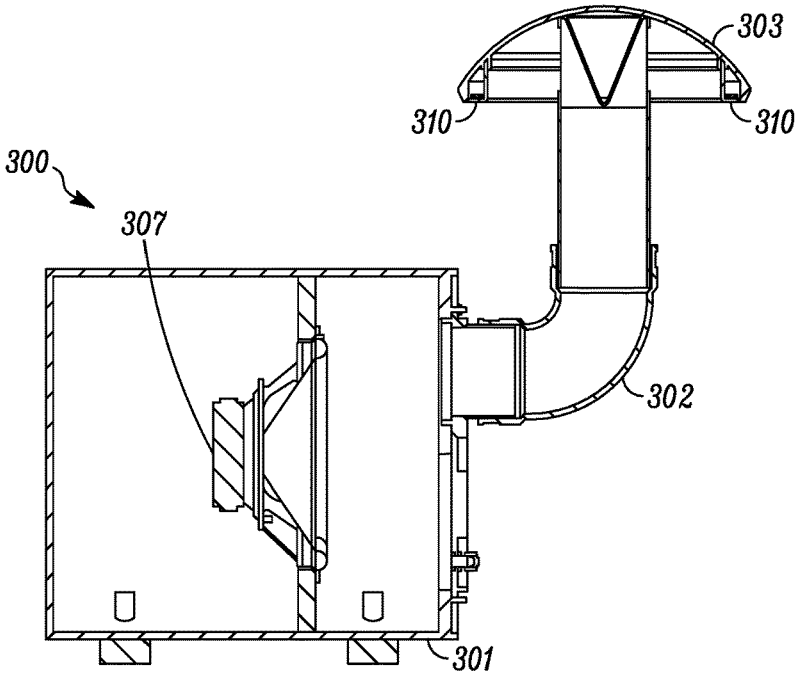
FIG. 14 illustrates a cross sectional view of a loudspeaker, taken generally along line 14-14 in FIG. 13.
Figure 15:
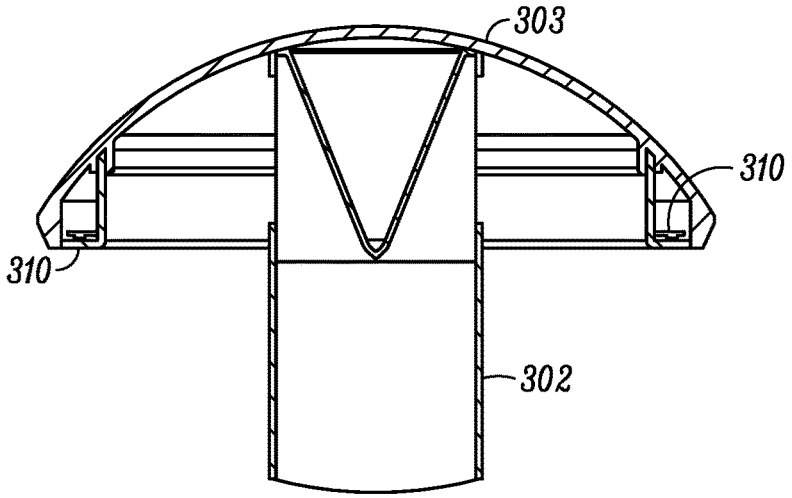
FIG. 15 illustrates an enlarged view of a top of the loudspeaker of FIG. 14 according to an embodiment of the present disclosure.
Figure 16:
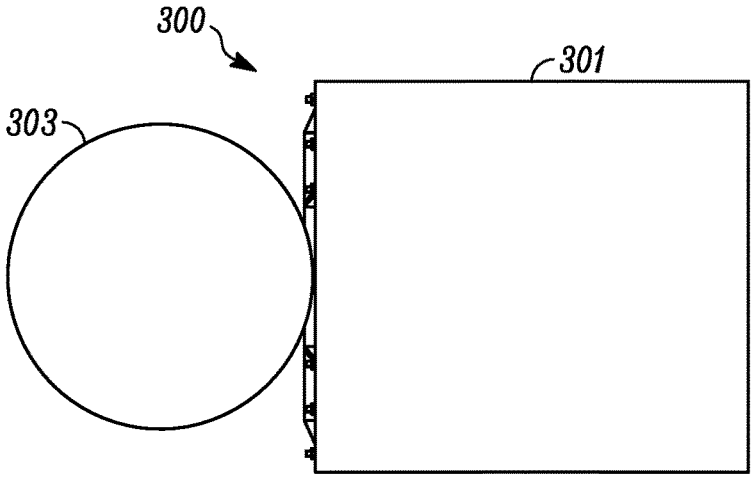
FIG. 16 illustrates a plan view of the loudspeaker according to an embodiment of the present disclosure.

FIGS. 12-16 illustrate a loudspeaker 300, which may be adapted to a low end of the frequency response. The loudspeaker 300 may be a woofer or sub-woofer. FIG. 12 shows a side view of the loudspeaker 300, which includes a chamber 301, a sound pipe 302, and a cap 303. The chamber 301 may be a cylinder. A sound emitter 307 is mounted in the chamber 301, which is shown in the cross sectional view (FIG. 14, taken generally along line 14-14 in the end view of FIG. 13). The sound emitter is electrically connected to a sound source. In an example, the chamber 201 and part of the pipe 302 are buried in the ground 314. The sound pipe 302 can be hollow pipe acting as a wave guide. The sound pipe 302 can be curved so that the chamber 301 is cylindrical with the sound being emitted out an end of the chamber essentially parallel to the ground level. The sound pipe 302 is gently curved so that the sound in the wave guide is curved upwardly to the cap 303 above the ground. A waveguide can be positioned at the end of the sound pipe 302 in the cap 303 to direct the soundwaves from the woofer's sound emitter, e.g., a driver or voice coil speaker outwardly in the cap. The waveguide has a v shape or a conical shape as shown in FIG. 14.

The cap 303 prevents rain and other moisture from entering the hollow sound pipe 302, while allowing sound to exit the above ground end of the sound pipe 302 distal to the chamber 301. The bottom of the cap 303 adjacent the sound pipe 302 and inwardly of outer raceway. The lighting device 310, e.g., a lamp, is fixed in the cap 303, e.g., in a raceway, which can be arcuate or circular around the periphery cap 303 radially outwardly sound pipe. In an example, the lighting device 310 is positioned at the periphery of the cap 303. The lighting device 310 may include the features of the lighting devices described herein.

Figure 17:
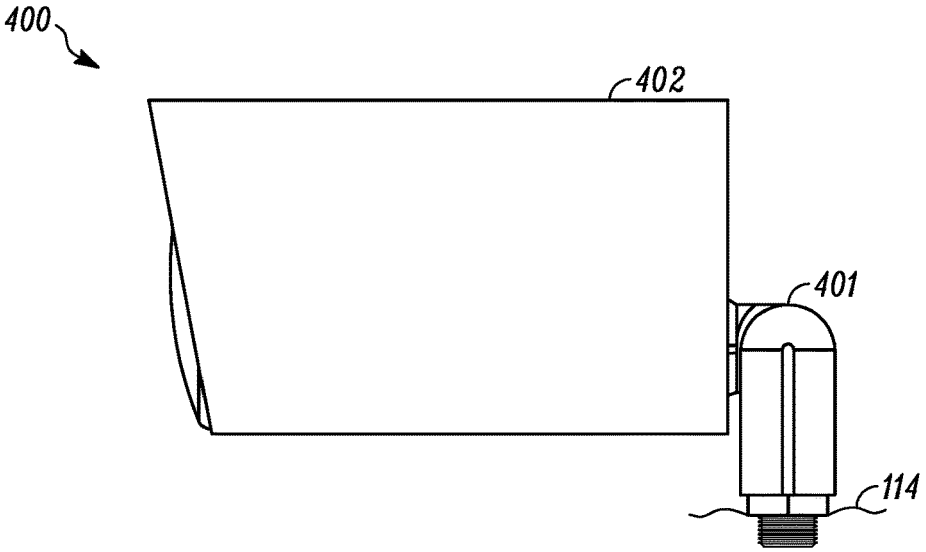
FIG. 17 illustrates an elevational view of a loudspeaker according to an embodiment of the present disclosure, as installed in the ground.
Figure 18:
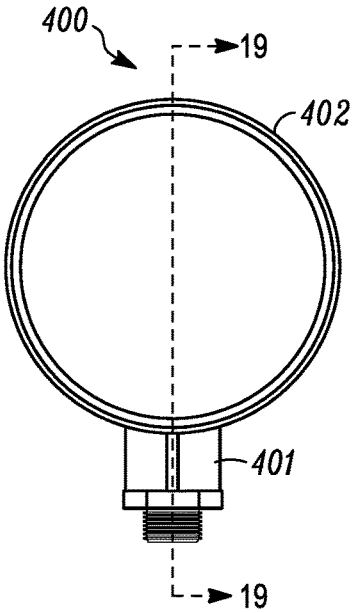
FIG. 18 illustrates a side elevational view of a loudspeaker according to an embodiment of the present disclosure
Figure 19:
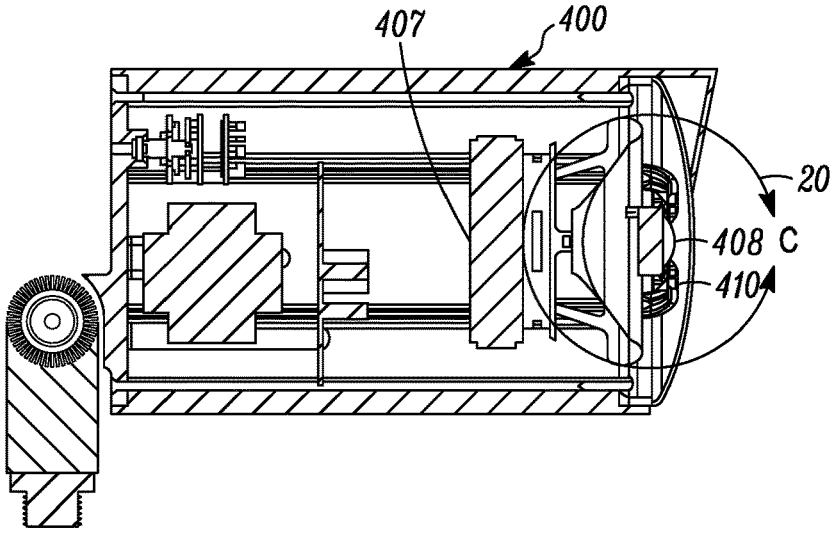
FIG. 19 illustrates a cross sectional view of a loudspeaker, taken generally along line 19-19 in FIG. 18.
Figure 20:
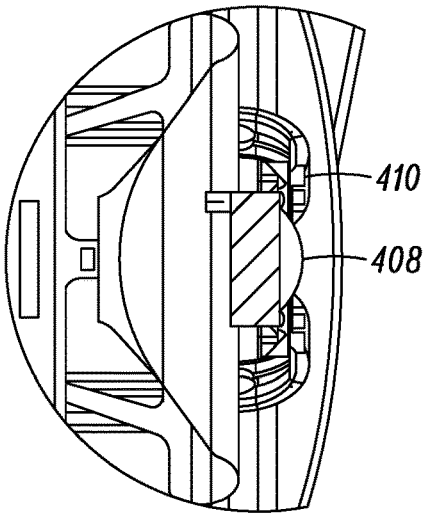
FIG. 20 illustrates an enlarged view of an end of the loudspeaker taker generally along line C in FIG. 19 according to an embodiment of the present disclosure.
Figure 21:
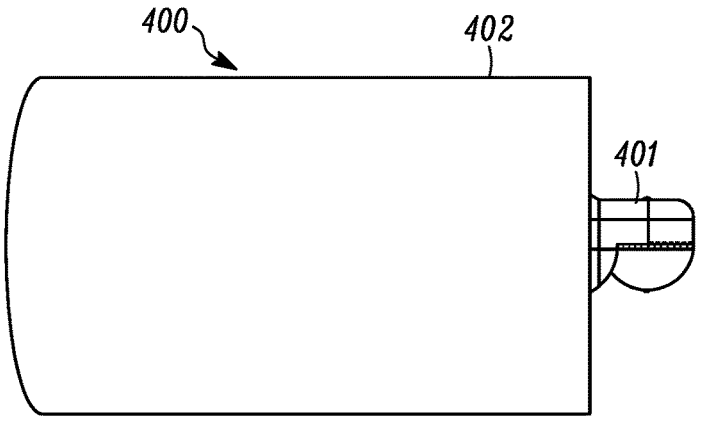
FIG. 21 illustrates a plan view of the loudspeaker according to an embodiment of the present disclosure.

FIGS. 17-21 illustrate a loudspeaker 400, which may be include a housing with a top part 402 pivotally mounted to a bottom part 401. FIG. 17 shows a side view of the loudspeaker 400, FIG. 18 is an end view of loudspeaker 400. FIG. 19 is a cross sectional view taken generally along line 19-19 of FIG. 18. FIG. 20 is an enlarged view taken generally along line 20 of FIG. 19. FIG. 21 is a top view. The bottom part 401 and top part 402 may include matching latches to fix the top part 402 relative to the bottom part 401 to direct the sound and light emitted from the loudspeaker. The top part 402 may be a cylinder. A driver 407 is mounted in the housing top part 402. The driver 407 is electrically connected to a sound source, e.g., audio dedicated circuitry. In an example, part of the bottom part 401 is buried in the ground or may be fixed to a conduit that may extend underground or be affixed to a structure. The lighting device 410 is fixed in the end of the top part 402 remote from the bottom part 401. In an example, the lighting device 410 is positioned at the distal end of the top part 402 adjacent the speaker 408. Another speaker 407 is mounted in the top part 402. The lighting device 410 may include the features of the lighting devices described herein.

Figure 22:
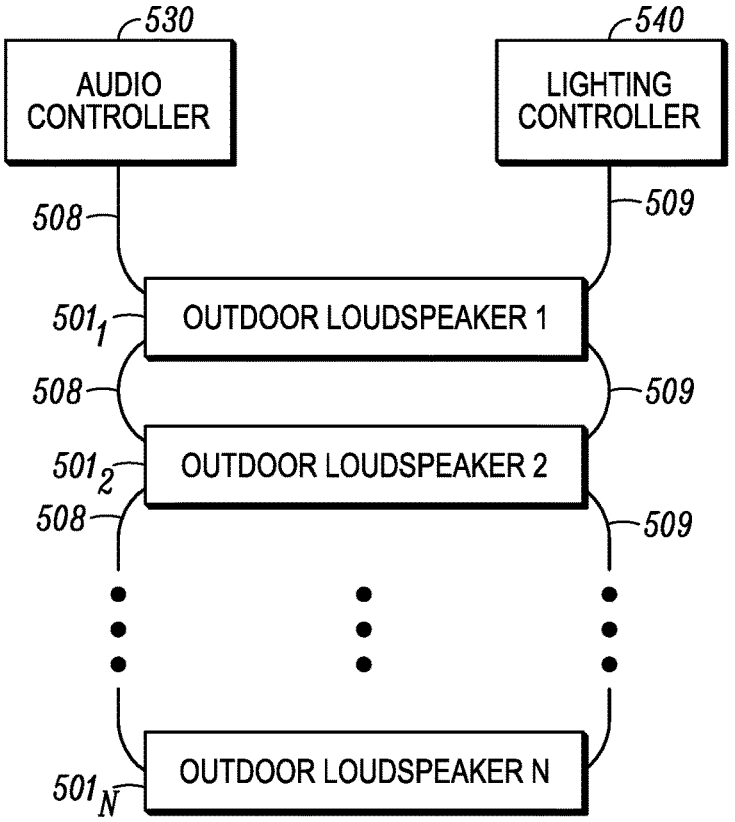
FIG. 22 shows a schematic view of an outdoor loudspeaker system according to an embodiment of the present disclosure.

FIG. 22 shows a schematic view of an outdoor loudspeaker system 500. A plurality of outdoor loudspeakers $\mathbf{501}_1$, $\mathbf{501}_2$, . . . $\mathbf{501}_N$ that can provide sound in an outdoor environment. The outdoor loudspeakers $\mathbf{501}_1$, $\mathbf{501}_2$, . . . $\mathbf{501}_N$ may be any of the loudspeakers as described herein. A sound controller 530 is provided to electrical send a sound signal to the outdoor loudspeakers $\mathbf{501}_1$, $\mathbf{501}_2$, . . . $\mathbf{501}_N$. A lighting controller 540 is provided to electrically send a lighting signal to the outdoor loudspeakers $\mathbf{501}_1$, $\mathbf{501}_2$, . . . $\mathbf{501}_N$. A first wiring 508 electrically connects the outdoor loudspeakers $\mathbf{501}_1$, $\mathbf{501}_2$, . . . $\mathbf{501}_N$ to the sound controller 530. A second wiring 509 electrically connects the outdoor loudspeakers $\mathbf{501}_1$, $\mathbf{501}_2$, . . . $\mathbf{501}_N$ to the lighting controller 540. In an example, the lighting controller 540 may be a computing device that executes stored lighting instructions. The sound controller 530 may include amplifiers, memory, audio storage, audio input and signal processors.

The lighting controller 540 may send power and control signals, e.g., over wires or wirelessly, to the outdoor loudspeakers to control the lamps and the light emitted from the lamps. The lamps include circuitry to receive the control signals and use the control signals to control the light emitted from the lamps. The lighting controller 540 can send a color control signal to select or change the color of the light emitted from the lamps. The lighting controller 540 can send brightness control signal to select the quantity of light, e.g., change the emitted lumens, or dim the light from the lamps.

The outdoor lighting system may include the lighting controller 540 and the lamps 110, 110A, 310 at the outdoor speakers. The controller 540 may automatically sense, convey, control and recording data relevant to the operation of the lighting system and each of the lamps controlled. At each of plural light locations in the network of lamps, there is a controller circuit that receives electric power input and control signals. The lighting system's power lines form portions of a bi-directional data link via which data is transmitted from each controller circuit to the lighting controller.

The loudspeakers may be mounted in an exterior wall, mounted to an exterior structure, such as a deck, a walkway, a pier, a dock, a fixed in the ground, or other outdoor structures. In at least one embodiment, the loudspeaker is a woofer, or subwoofer. The term woofer may mean either a subwoofer or a traditional woofer. Subwoofers and traditional woofers operate in a low frequency range, e.g., the bass range. In general, the bass range is a low frequency range, which may be around 20 Hertz (Hz) to 400 Hz. In the bass range, subwoofers generally emit sound between 20 Hz and 200 Hz, and traditional woofers generally emit sound between 40 Hz and 400 Hz. As used herein, the woofer could be a subwoofer or a traditional woofer.

The above described embodiments of the loudspeakers have a generally round shape where the lights are located, in will be understood that other shapes are within the scope of the present invention. The light supporting structures may have a polygon shape, a partly polygon shape, ovoid, or partly ovoid shape.

Many of the above described embodiments show a loudspeaker that is mounted in the ground. Other mounts may be within the scope of the present invention. In an example, the loudspeaker may include a mount that allows the speaker to hang, e.g., like a pendant, from a support, which may be mounted to a building, on the ground, on a deck, on a dock or the like.

An outdoor loudspeaker may include audio circuitry and lighting circuitry, which may be connected to separate signal sources. The lighting circuitry may produce light from a light signal source. The audio circuitry may produce audio from an audio signal source. The lighting circuitry and the audio circuitry may be in a housing that protects both from the outside environment, e.g., sun, rain, moisture, mechanical contact.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

We claim:

1. An outdoor loudspeaker system, comprising:

a plurality of outdoor loudspeakers each including an audio driver, a top arranged on a base and a cap arranged on the top, a lamp mounted beneath the cap and outside the top, wherein the cap includes a centrally mounted lens above the lamp, the lens mounted in webs in the cap above the audio driver, wherein the audio driver is configured to output sound upwardly around the lens and through interstices between the webs;

a lighting controller to output lighting signals to the lamp of the one or more than one outdoor loudspeakers;

an audio controller to output audio signals to the audio driver to the one or more than one outdoor loudspeakers;

a lighting conduit housing lighting wiring from the lighting controller to the one or more than one outdoor loudspeakers; and an audio conduit housing audio wiring from the audio controller to the one or more than one outdoor loudspeakers, the audio conduit being separate from the lighting conduit.

2. The system of claim 1, wherein the lighting wiring extends into the base and through the top to the lamp.

3. The system of claim 1, wherein the cap is opaque above the lamp to direct emitted light below the cap and the cap covers the top to protect the top and the audio driver from the environment.

4. The system of claim 3, wherein the cap includes a brim outside the top and the lamp is mounted in the brim.

5. The system of claim 1, wherein the lamp includes a plurality of light sources mounted around a periphery of the cap and facing downwardly with light being emitted through a gap between the top and the cap.

6. The system of claim 5, further comprising a spike connected to each base and extending downwardly to secure the respective loudspeaker to the ground.

7. The system of claim 1, wherein the audio driver is a woofer mounted in a chamber of the base and the chamber being adapted beneath the ground, and further comprising a sound pipe configured to transmit the sound waves from the chamber to an outlet at the cap, the cap including the lamp mounted in a raceway at periphery of the cap, wherein the cap includes a waveguide to direct the woofer sound waves outwardly beneath the cap, wherein the cap includes a sound exit intermediate the sound pipe and the raceway.

8. The system of claim 7, wherein the raceway acts as a light guide to transmit the light around the cap and outwardly of the cap.

9. The system of claim 2, wherein the audio conduit and the lighting conduit extend below ground to the base.

10. The system of claim 1, wherein the light controller sends a first control signal to the lamp to control a quantity of light from the lamp and a second control signal to select a color of light from the lamps.

11. An outdoor loudspeaker, comprising:

an elongate base configured to be at least partially mounted in the ground;

a top on the base;

an audio driver mounted in the top;

a cap on the top, the cap including a brim extending outwardly of the top;

a lamp mounted in the brim, the cap being adapted to cover the lamp and direct emitted light downwardly and outwardly from the cap, wherein the cap includes a lens above the lamp, the lens is mounted in webs in the cap above the audio driver, wherein the audio driver is configured to output sound upwardly around the lens and through interstices between the webs;

first circuitry connected to the audio driver; and second circuitry separate from the first circuitry and connected to the lamp.

12. The outdoor loudspeaker of claim 11, wherein the lamp includes a plurality of light sources, and wherein the light sources are mounted around a periphery of the cap facing downwardly with light being emitted through a gap between the top and the cap.

13. The outdoor loudspeaker of claim 11, further comprising a spike extending downwardly from the base to secure the loudspeaker to the ground.

14. The outdoor loudspeaker of claim 11, wherein the lamp includes light emitting diodes configured to emit programmable ranges of wavelengths to control the color of light emitted from the lamp.

15. The outdoor loudspeaker of claim 11, wherein the audio driver is below the lamp.

16. The outdoor loudspeaker of claim 11, wherein the lamp includes circuitry to receive signals to control both the quantity of light and the color of light emitted therefrom.

17. An outdoor loudspeaker system, comprising:

at least one outdoor loudspeaker including an audio driver, a top arranged on a base and a cap arranged on the top, a lamp mounted beneath the cap and outside the top, wherein the cap includes a centrally mounted lens above the lamp, the lens mounted in webs in the cap above the audio driver, wherein the audio driver is configured to output sound upwardly around the lens and through interstices between the webs.

* * * * *